United States Patent [19]

Brown

[11] 4,355,586

[45] Oct. 26, 1982

[54] SOLID FUEL GASIFICATION SYSTEM

[76] Inventor: Charles K. Brown, 8317 Robert Bruce Dr., Richmond, Va. 23235

[21] Appl. No.: 207,648

[22] Filed: Nov. 17, 1980

[51] Int. Cl.[3] ..... F23G 5/00

[52] U.S. Cl. ..... 110/229; 110/232; 241/188 A

[58] Field of Search ..... 110/229, 232, 263; 347; 241/188 R, 188 A; 48/77

[56] References Cited

U.S. PATENT DOCUMENTS

| | | | |
|---|---|---|---|
| 3,317,975 | 5/1967 | Parmele | 241/188 A |
| 3,818,869 | 6/1974 | Blaskowski | 110/229 X |
| 4,306,506 | 12/1981 | Rotter | 110/229 |

*Primary Examiner*—Edward G. Favors
*Attorney, Agent, or Firm*—Walter G. Finch

[57] ABSTRACT

The invention is an improved system for solid fuel gasification, such as coal. A coal type fuel is reduced to as near a one hundred percent molecularly dispersed condition as possible to achieve the maximum efficiency of combustion in a combustion type device. The system consists of a series of steps. The first step mechanically pulverizes the coal to pass through a 300 mesh screen. The second step thermally drives off the volatile gases and the char is burned to a carbon monoxide gas state. The resulting gasified coal combination is then fed to the burners of the combustion type device.

9 Claims, 2 Drawing Figures

SOLID FUEL GASIFICATION SYSTEM

BACKGROUND AND SUMMARY OF THE INVENTION

The invention relates to solid fuels and in particular to coal type fuels. Specifically, the invention concerns converting coal type fuels to gas type fuels.

In the critical energy situation the need for an efficient means for converting solid fuel, such as coal, to a gas type fuel for a more efficient use, is of prime importance. The present invention provides such a means.

Many combustion type devices today are either oil fired or gas fired, and in some areas it may be said that most of the combustion type devices use either oil or gas. With the present critical fuel shortage and the related problems, such as the high cost of oil and the risks involved in obtaining foreign supplies, a need exists for using solid fuels, such as coal, which are in abundant supply in the United States.

The problems involved in using the solid fuels, such as coal, are the high costs of converting the oil or gas fired combustion devices to use it in the solid state, a means of using those solid fuels that may not be of the highest quality, and a means of using those solid fuels efficiently. The present invention solves these problems.

In the present invention it is possible to use the gas, developed from the solid coal type fuel, in gas or oil fired burners with a minimum of conversion expense.

The pulverizing system of the present invention, the first step in the system, is more efficient than the outmoded ball mills or roller mills.

One of the problems of burning coal as a solid fuel in the conventional manner is contamination of the atmosphere with sulphur dioxide. In the present invention the gas is separated from the char particles of coal after the coal is gas fired and the gas is purified on its way to the combustion type device for final combustion in combination with the char particles.

The aforementioned procedure permits processing a smaller volume of gas to eliminate the impurities, rather than first burning the coal in the solid state and then purifying all of the gases of combustion which are of a greater volume magnitude. The action is accomplished in conjunction with a unique form of pulverizer in this invention.

The coal gasification system of this invention operates at atmospheric pressure, can be driven by electric motors, or steam turbines, or comparable means, will process an enormous volume of solid fuel, such as coal, per hour, and in a relatively small compact unit that utilizes very little space.

The pulverizer of this invention operates on the principle of the solid fuel, such as coal, being hurled at a very high velocity from fast spinning annular rings n multiple counter rotating streams, each at a very high velocity. The high energy impact shatters the particles of solid fuel and the consequent abrasion resulting from contact with particles of material being carried on the counter rotating annular rings further reduces the particle size.

In the second step the finely pulverized solid fuel is completely dispersed in the contained atmosphere, as it comes from the pulverizing step, and is passed through a flame for partial combustion for conversion to a gas. Depending upon the solid fuel involved, this step results in products of ethane, methane, propane, carbon monoxide, and sulphur dioxide. Thus, complete gasification of the solid fuel to a ready state for feeding to the combustion type device, where additional oxygen is added for the final combustion.

As to burning the pulverized solid fuel without gasifying it: the gasified solid fuel, such as coal, lends itself to relatively simple desulphurization and purification to meet Environmental Protection Administration standards; and the molecular sized gas particles burn hotter and more efficiently than the micron size coal particles, which results in significant savings in fuel costs.

With the gasification system of this invention, a package unit for gasification can be installed right at the combustion type device. This is more efficient and far less expensive than piping the gas to the combustion type device from a very distant and very expensive central gasifying system.

Present gasifying systems have an objective of obtaining as high a BTU content into the volume of gas as possible. To do this requires high temperatures and high pressures. With the present invention making the conversion right at the combustion type device the procedure is much simpler.

It is, therefore, an object of the invention to provide a solid fuel gasification system capable of converting solid fuels, such as coal, to a gas type fuel.

It is another object of the invention to provide a solid fuel gasification system that does not require extensive and expensive conversion means to gas and oil fired combustion devices to utilize gas from the solid fuel gasification.

It is also an object of the invention to provide a solid fuel gasification system that is capable of gasifying solid fuels that may be less than the lightest quality.

It is still another object of the invention to provide a solid fuel gasification system that has a unique means of pulverizing the solid fuel as a first step.

It is yet another object of the invention to provide a solid fuel gasification system that completely disperses the pulverized solid fuel in the contained atmosphere and passes it through a flame for partial combustion for conversion to a gas as a second step.

It is also another object of the invention to provide a solid fuel gasification system that eliminates contaminants before final burning of the gas from the gasification system.

It is yet still another object of the invention to provide a solid fuel gasification system that may be assembled into a compact unit at the combustion type device instead of requiring a large central distribution means.

Further objects and advantages of the invention will become more apparent in the light of the following description of the preferred embodiments.

DESCRIPTION OF THE PREFERRED EMBODIMENTS

Figure 1:
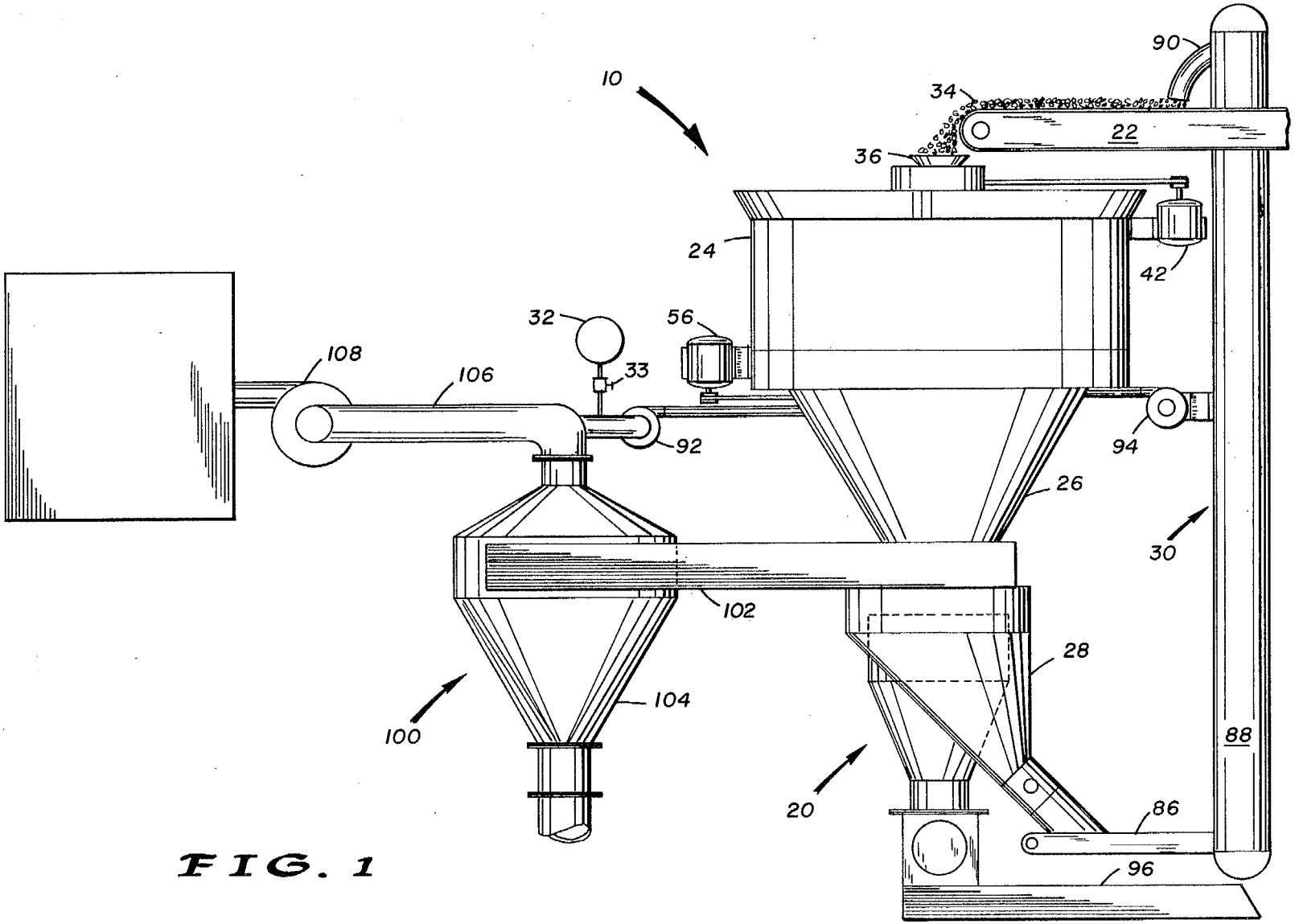
FIG. 1 is a generalized side view of a solid fuel gasification system.

Referring to the drawings and particularly to FIG. 1, a solid fuel gasification system is shown at 10.

The solid fuel gasification system 10, shown in FIG. 1, consists of a solid fuel gasification portion or section 20 and a gas cleaning portion or section 100. The details of the solid fuel gasification portion or section 20 and the gas cleaning portion or section 100 are described hereinafter.

The solid fuel gasification portion 20 consists of a solid fuel feed means 22, a solid fuel pulverizing means 24, a thermal gasification means 26, a separation means 28, a recycling means 30, and a start-up means 32. The aforementioned means, shown in FIG. 1, are shown in detail in FIG. 2 which is described hereinafter.

The gas cleaning portion 100 consists of a gas supply means 102, a gas cleaning means 104, and a gas delivery means 106 to a combustion type device 108.

Figure 2:
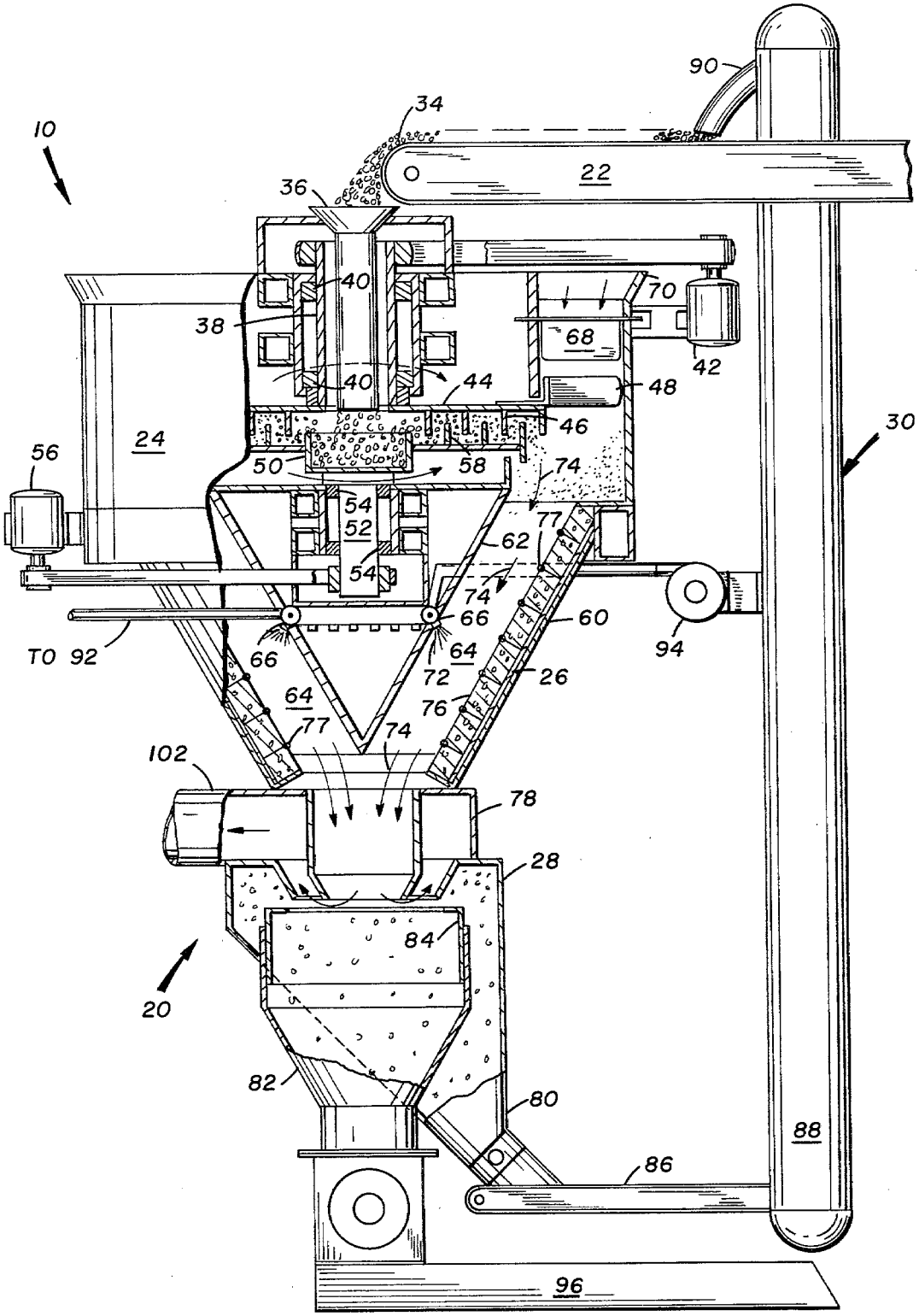
FIG. 2 is a partial cross sectional side view of the solid fuel gasification portion of FIG. 1.

Referring now to FIG. 2, the solid fuel gasification portion 20 of the solid fuel gasification system 10 is shown in a partial cross sectional view in FIG. 2.

Solid fuel, such as coal, is fed from a main supply point (not shown) by means of the solid fuel feed means 22, such as a conveyor. The main supply point of solid fuel may be an open air storage pile, a hopper means, or any similar facility for providing bulk storage of the solid fuel.

The solid fuel feed means 22 feeds the solid fuel 34 into a funnel-like feed tube 36. The funnel-like feed tube 36 extends through a hollow shaft means 38 and feeds the solid fuel 34 into a lower pulverizing rotor 50, described hereinafter.

The hollow shaft means 38 is supported by bearings 40 mounted within the structure of the solid fuel pulverizing means 24. The hollow shaft means 38 is driven by a motor means 42. Affixed to the lower end of the hollow shaft means 38 is an upper pulverizing rotor 44, described hereinafter. The rotor 44 is centrally located on the hollow shaft means 38.

The upper pulverizing rotor 44 has a plurality of downwardly projecting annular concentric rings 46 affixed to the lower face of the upper pulverizing rotor 44. A plurality of fan blade 48, described later as to the configuration and operation, are affixed around the outer periphery of the upper pulverizing rotor 44.

The lower pulverizing rotor 50 is centrally mounted on a shaft means 52 which is supported by bearings 54, mounted within the structures of the solid fuel pulverizing means 24 and the thermal gasification means 26. The shaft means 52 is driven by a motor means 56. The center line of the shaft means 52 coincides with the centerline of the hollow shaft means 38.

The lower pulverizing rotor 50 has a plurality of upwardly projecting annular concentric rings 58 affixed to the upper face of the lower pulverizing rotor 50.

The plurality of downwardly projecting annular concentric rings 46 affixed to the lower face of the upper pulverizing rotor 44 are each alternately concentric with the upwardly projecting annular concentric rings 58 affixed to the upper face of the lower pulverizing rotor 50. The downwardly projecting annular concentric rings 46 and the upwardly projecting annular concentric rings 58 interject into and within the area of each other approximately one-half of the total depth of the area. The alternating concentric rings 46 and 58 of the upper and lower pulverizing rotors 44 and 50 respectively are centered between each other in the injecting configuration.

The upper and lower pulverizing rotors 44 and 50, respectively, rotate in opposite directions. For purposes of this invention the lower pulverizing rotor 50 will be described as rotating in a clockwise direction and the upper pulverizing rotor 44 will be described as rotating in a counter-clockwise direction. It is to be understood that to rotate the upper and lower pulverizing rotors 44 and 50, respectively, in clockwise and counter-clockwise directions, respectively is within the scope and intent of this invention.

The rotation of the upper and lower pulverizing discs 44 and 50 at speeds of 1500 to 2500 RPM throws the solid fuel particles outwardly by centrifugal forces as will be described hereinafter. It is to be understood that rotating speeds other than those mentioned are within the scope and intent of this invention.

As the solid fuel 34, such as coal, passes down the funnel-like feed tube 36 it drops into the center of the first annular concentric ring 58 of the rotating lower pulverizing rotor 50. The rotating lower pulverizing rotor 50 throws the solid fuel particles 34 in an outwardly direction by centrifugal force. The solid fuel particles 34 are hurled at high velocity from the high speed spinning annular rings 58 and 46 alternately in multiple counter-rotating streams that collide with each other as the alternate streams meet each other at high velocity.

The high energy impacts of the particles shatters into subsequently still finer particles. The consequent abrasion that results from contact with particles being carried on the counter-rotating annular rings 58 and 46 alternately further reduces the particle size.

As the aforementioned centrifugal force throws the solid fuel 34 particles outwardly from the center of the first annular ring 58 where it was deposited from the funnel-like feed tube 36, the particles are restrained by the verticle wall of the first annular ring 58. As the pressure builds up and the layer becomes thicker, the solid fuel 34 particles starts to shear off at an angle of approximately 60° and slip over the upper edge, of the first annular ring 58, at or near the rim speed of the lower pulverizing rotor 50.

The partially pulverized solid fuel 34, slipping over the first annular ring 58, leaves the rim at the aforementioned high rate of speed and on a tangential upwardly inclined path. The flying particles collide in a sheet spray pattern with the particles that have built up on the inner surface of the first annular ring 46, on the upper pulverizing rotor 44, where decelleration takes place and acceleration begins instantly in the opposite direction, due to the counter-rotating direction of the upper pulverizing rotor 44.

The alternating change in direction occurs in the same manner as the solid fuel particles, continues to alternately pass from one rotating pulverizing rotor to the other pulverizing rotor; the particles alternately slipping over each successive annular ring 58 and 46, respectively, until the solid fuel particles finally leave the last or outer annular ring 46 as micronic sized solid fuel dust particles.

As the micronic sized solid fuel dust particles leave the last or outer annular ring 46, they are hurled toward the outside wall 60 of the thermal gasification means 26. The thermal gasification means 26 has an outside wall 60 and a parallel inner wall 62. The thermal gasification means 26 is cone shaped and the parallel outside and inside walls 60 and 62, respectively, are likewise cone shaped. The walls 60 and 62 are spaced apart to provide a gasification chamber 64 which has the cone-like configuration of the enclosing walls 60 and 62.

As the micronic sized solid fuel dust particles pass into the gasification chamber 64 area, as they are hurled from the last or outer annual ring 46 toward the outside wall 60, they are blown downwardly by the wind action or wind stream of the fan blades 48 affixed to and around the periphery of the upper pulverizing rotor 44. The fan blades 48 are set at an angle to the horizontal to force a stream of air downwardly as they travel at the speed of rotation of upper pulverizing rotor 44.

Varying the speed of the upper and lower pulverizing rotors 44 and 50, respectively, will vary the degree of pulverization to some extent. Some mechanical separation of impurities from the solid fuel particles may occur. "Clean" solid fuel (such as coal) will pulverize more readily than "impure" solid fuel.

For example, "bone" coal, or impure coal, tends to be harder and will not break down into particles small enough to gasify readily and will be thrown out of the gas stream by centrifugal force in a separator chamber down stream in the solid fuel gasification system 10. This action also reduces the ash content of the fuel reaching the combustion type device 108. The upper and lower pulverizing rotors 44 and 50, respectively, must be run at a speed that is fast enough to pulverize the solid fuel, but not the "bone".

As the air and solid fuel dust mixture moves downwardly in the gasification chamber 64, it meets an annular ring burner 66 that subjects the mixture to a rapid increase in temperature. This rapid increase in temperature will drive off the volatile material in the dust particles and further fractionate them due to the internal gas expansion. Exposure to the flame in a reducing atmosphere will burn the char particles to produce carbon monoxide gas. Damper blades 68 around the interior periphery of the air ducts 70, in the structure of the solid fuel pulverizing means 24, that lead to the gasification chamber 64, control the flow of air.

It is to be noted that the annular ring burner 66 around, and situated at, the inside wall 62 of the gasification chamber 64, and spaced from the ends of the inside wall 62, provides an annular flame 72 around, and across, the gasification chamber 64 so that all of the air and solid fuel dust particles mixture must pass through it for the gasification action described hereinbefore. The direction of flow of the air and solid fuel dust particles is indicated by arrows 74. A fire brick lining 76 protects the exterior or outside wall 60 from the annular flame 72. Boiler feed water preheating piping 77 encircles the gasification chamber 64 at the fire brick lining 76 for boiler water preheating.

It is to be noted that the passage of the solid fuel 34 particles through the series of compartments formed by the upper and lower annular rings 46 and 58 respectively and then downwardly through gasification chamber 64 occurs around the entire periphery of the solid fuel pulverizing means 24 and the thermal gasification means 26 respectively, but is shown only on one portion of the partial cross-sectional view in FIG. 2 for purposes of clarity.

As the aforementioned volatile gases and the carbon monoxide gas reach the bottom of the gasification chamber 64 in their downward movement, the volatile gases and the carbon monoxide gas mixture pass through the separation means 28 where the mixture of gases is shunted toward the gas cleaning portion 100 of the solid fuel gasification system 10.

The action in the separation means 28 takes three paths. The volatile gases and carbon monoxide mixture is shunted through ducts 78 toward the gas cleaning portion 100, solid fuel or char particles that are not gasified or carried along with the gases mixture are shunted through chute 80 toward the recycling means 30, and heavier waste products from the operation up to this point are shunted through the collector bin 82. A baffle 84 in the collector bin deflects the aforementioned gases mixture and char particles and permits the waste materials to pass into the collector bin 82 for disposal means 96.

The recycling means 30 consists of a conveyor component 86 to transfer the char particles to an elevator component 88. The elevator component 88 subsequently delivers the char particles to the solid fuel feed means 22 through elevator chute 90 for the recycling operation.

To produce the flame 72 a portion of the gases mixture is drawn off by gas blower 92 and mixed with the proper amount of air from an auxiliary blower 94. At start-up of the system, the start-up means 32, with control valve 33, provides a gas, such as propane, to the gas blower 92 to produce the flame 72.

Turning now to the gas cleaning portion 100 of the solid fuel gasification system 10, when the gases mixture are shunted into duct 78 they are conducted to the gas supply means 102, which essentially is the main supply duct to the gas cleaning means 104.

The gas cleaning means 104 is a combination of known means for cleaning the gases of sulphur dioxide and other impurities that are required to be removed. After the gases have been cleaned they are transported via the gas delivery means 106 to the burners of the combustion type devices 108, such as a boiler system in an industrial plant.

Proper instrumentation as known in the art is included in the system as necessary to control the various stages of the operation. Also included in the system is adequate insulation of those portions of the structure where heat is generated in order to improve the efficiency.

It is to be noted that four annular concentric rings 46 are shown on the upper pulverizing rotor 44 and four annular concentric rings 58 are shown on the lower pulverizing rotor 50. However, it is to be understood that the aforementioned plurality of such annular concentric rings may be any number to achieve the degree of pulverization required in one pass. For best results approximately 90 percent should pass a 300 mesh sieve.

To take further advantage of the heat generated by the flame 72, feed water pipes 77 can be installed to preheat the feed water, in a boiler type installation as an example. This takes advantage of what otherwise would be a heat loss in the overall system.

It is also to be noted and understood that the means for separating the gases mixture, the char or other particles to be recycled, and the waste matter can be varied in several arrangements or configurations of the structure, however, the end result is the same; the gases mixture is routed toward the point of use, perhaps with an intermittent processing to remove impurities as may be required, the particles that need further processing are recycled by a separate routing, and the waste products are discarded. The embodiment shown is a preferred method and procedure as being one that is efficient.

A second embodiment is to control the heat applied by the flame 72 so that only enough heat is applied to pulverized dust of the solid fuel to volatize only the major portion of the highly volatile materials in the solid fuel, including such materials as sulphur. These volitized gases are then shunted, as before, to the gas cleaning portion 100 and processed accordingly. The remaining charred particles are separated from the gas stream as before, but only excessively oversize particles would be recycled. The bulk of the charred particles would be directed by chute and conveyor means directly to the combustion type device 108 and burned in particulate form.

As noted hereinbefore, the cleaning of the gases before use in the combustion type device 108 is more economical and efficient than cleaning all of the stack gases of final combustion.

An advantage of the system of this invention is that burning straight pulverized solid fuel in a combustion type device 108 requires that all of the combustion must take place in one step and in a given amount of time. Furthermore, all of the resulting stack gases would have to be cleaned.

In the system of the present invention, the gases brought to the combustion type device 108 will burn faster and hotter because it is already in a molecular state that will combine more readily with the oxygen in the air. As to the char that is thoroughly dispersed in the burning gas, it will heat up faster and burn quicker and hotter due to the kindling action of the burning gases which surround the carbon particles. The quicker a given amount of fuel burns the more heat it produces and the more efficient is the boiler operation.

As can be readily understood from the foregoing description of the invention, the present structure can be configured in different modes to provide the ability to gasify solid fuels.

Accordingly, modifications and variations to which the invention is susceptible may be practiced without departing from the scope and intent of the appended claims.

What is claimed is:

1. A solid fuel gasification system, comprising:

a solid fuel gasification section, said solid fuel gasification section having a fuel feed means, a gas cleaning section, said gas cleaning section being connected to said solid fuel gasification section, a fuel pulverizing means, a thermal gasification means, and a separation means, said fuel pulverizing means being connected to said fuel feed means, said thermal gasification means being connected to said fuel pulverizing means, and said separation means being connected to said thermal gasification means, said fuel pulverizing means having a hollow shaft means, an upper pulverizing rotor, a plurality of first annular concentric rings, a lower pulverizing rotor, a plurality of second annular concentric rings, and a solid shaft means, said upper pulverizing rotor being centrally affixed to said hollow shaft means, said upper pulverizing rotor having an upper and a lower surface, said plurality of first annular concentric rings being affixed to the lowermost surface of said upper pulverizing rotor, said plurality of first annular concentric rings projecting downwardly from said lowermost surface of said rotor, said lower pulverizing rotor having an upper and a lower surface, the plane of said lower pulverizing rotor being parallel to and spaced from the plane of said upper pulverizing rotor, said plurality of second annular concentric rings being affixed to the uppermost surface of said lower pulverizing rotor, said plurality of second annular concentric rings projecting upwardly from said uppermost surface of said rotor, said solid shaft means being centrally affixed to said lower pulverizing rotor, the centerline of said solid shaft means coinciding with the centerline of said hollow shaft means, said thermal gasification means having an outside wall means, an inside wall means, and an annular ring burner, said outside wall means being of a conical-like configuration, said inside wall means being of a conical-like configuration and spaced from and parallel to said outside wall means, said spaced area between said outside and said inside wall means forming a gasification chember, said annular ring burner encircling said inside wall means and being spaced from the ends of said inside wall means, said annular ring burner being capable of supplying a peripheral flame around and across said gasification chamber.

2. A solid fuel gasification system as recited in claim 1, and additionally a recycling means, said recycling means being connected to said separation means.

3. A solid fuel gasification means as recited in claim 1, wherein said fuel feed means consists of:

a conveyor component, said conveyor component conveying fuel from a bulk storage point to said solid fuel gasification section; and a funnel-like feed tube, said funnel-like feed tube receiving said fuel from said conveyor component and conducting said fuel to said fuel pulverizing means.

4. A solid fuel gasification system as recited in claim 1, wherein said separation means consists of:

a duct means, said duct means conveying gases from said thermal gasification means to said gas cleaning section;

a chute means, said chute means being located adjacent to said duct means and conveying char residue from said thermal gasification means to a subsequent recycling means; and a waste collection bin, said waste collection bin being located adjacent to said duct means and said chute means and receiving residue not conveyed away by said chute means.

5. A solid fuel gasification system as recited in claim 2, wherein said recycling means consists of:

a conveyor element, said conveyor element receiving and conveying material to be recycled from said separation means;

an elevator component, said elevator component being located adjacent to said conveyor element, said elevator component receiving material to be recycled from said conveyor element and transporting said material to be recycled to location of said fuel feed means; and an elevator chute, said elevator chute being affixed to said elevator component, said elevator chute receiving material to be recycled from said elevator component and conveying said material to be recycled to said fuel feed means.

6. A solid fuel gasification system as recited in claim 1, wherein said gas cleaning section consists of:

a gas supply means, said gas supply means receiving gas to be cleaned from said solid fuel gasification section;

a gas cleaning means, said gas cleaning means being conducted to said gas supply means and receiving gas therefrom to be cleaned; and a gas delivery means, said gas delivery means being connected to said gas cleaning means and receiving cleaned gas therefrom for delivery to an end use device.

7. A solid fuel gasification system as recited in claim 1, wherein said plurality of first annular concentric rings projecting downwardly interject partially into spaced apart areas of said plurality of second annular concentric rings projecting upwardly and concurrently said plurality of second annular concentric rings projecting upwardly interject partially into spaced apart areas of said plurality of first annular concentric rings projecting downwardly.

8. A solid fuel gasification system as recited in claim 1, and additionally, a start-up means, said start-up means being connected to said annular ring burner for purposes of initial start-up when said solid fuel gasification system is put into operation after inoperation.

9. A solid fuel gasification system as recited in claim 1, and additionally, a plurality of fan blade means, said fan blade means being affixed to and spaced around the periphery of said upper pulverizing rotor, said plurality of fan blade means providing a stream of air into and downwardly moving in said gasification chamber.

* * * * *